US005870990A

United States Patent [19]

Sczepanski

[11] Patent Number: 5,870,990

[45] Date of Patent: Feb. 16, 1999

[54] CYLINDER BORE LINER FOR AN INTERNAL COMBUSTION ENGINE

[75] Inventor: Jeffry Gerard Sczepanski, Northville, Mich.

[73] Assignee: Ford Global Technologies, Inc., Dearborn, Mich.

[21] Appl. No.: 921,966

[22] Filed: Sep. 2, 1997

[51] Int. Cl.[6] ..... F02F 1/00

[52] U.S. Cl. ..... 123/193.2

[58] Field of Search ..... 123/193.2; 29/888

[56] References Cited

U.S. PATENT DOCUMENTS

| | | | |
|---|---|---|---|
| 4,347,018 | 8/1982 | Wrightson et al. . | |
| 4,370,788 | 2/1983 | Baker . | |
| 4,849,594 | 7/1989 | Balzer . | |
| 4,937,927 | 7/1990 | Taipale . | |
| 4,986,230 | 1/1991 | Panyard et al. | 123/193.2 |
| 5,183,025 | 2/1993 | Jorstad et al. . | |
| 5,419,037 | 5/1995 | Bailey . | |
| 5,598,818 | 2/1997 | Domanchuk . | |

FOREIGN PATENT DOCUMENTS

| | | |
|---|---|---|
| 398009 | of 0000 | United Kingdom . |
| 1 395 220 | 5/1975 | United Kingdom . |

*Primary Examiner*—Marguerite McMahon
*Attorney, Agent, or Firm*—Neil P. Ferraro

[57] ABSTRACT

A cylinder bore liner for an internal combustion engine is formed of a sheet of material in the shape of a non-rectangular parallelogram having oblique edges is formed into a cylindrical liner with the abutting edges vertically offset to form a cylinder of smaller diameter than the diameter of a cylinder bore. The liner is then inserted into the cylinder bore of the engine with the leading edge resting on a ledge in the bore, and the trailing edge protruding from the top of the bore. A force is applied to the protruding edge of the liner to force a sliding motion along the oblique abutting edges which necessarily increases the diameter of the liner until a tight fit is achieved.

20 Claims, 3 Drawing Sheets

CYLINDER BORE LINER FOR AN INTERNAL COMBUSTION ENGINE

FIELD OF THE INVENTION

This invention relates to cylinder bore liners for internal combustion engines, and more particularly, to cylinder bore liners requiring low insertion energy.

BACKGROUND OF THE INVENTION

It is common practice to manufacture cylinder blocks for internal combustion engines out of aluminum because of the weight reduction benefits gained. However, the material properties of aluminum require that a liner of a different material, usually cast iron or steel, be inserted into the cylinder bores in order to withstand the heat and forces generated within the cylinder. There are several methods of inserting the liner, dependent on the material used for the liner and the thickness of the liner, among other factors.

For example, it is beneficial to have a thin walled liner to improve thermal conductivity and reduce weight. The commonly used methods to insert thin walled liners involve either heating of the cylinder block to cause expansion while simultaneously cooling the liner to cause shrinkage, and then inserting the liner into the cylinder to produce a shrink fit, or forming a sheet of material into a cylindrical liner and inserting the liner into the bore using a interference press fit over the entire distance of the cylinder bore, as described in British Patent Specification 1395220.

The inventor of the present invention has found certain disadvantages with these prior art insertion methods. Primarily, high energy levels are required to accomplish insertion and the types of materials that can be used are limited. With respect to the interference press fit method described, application of high load is required to force the interference fit over the entire height of the cylinder liner resulting in high energy expenditure requirements. This method also requires that either an internal support be provided, or that the thickness and material of the liner be sufficient such that the liner does not buckle on insertion.

SUMMARY OF THE INVENTION

An object of the present invention is to provide a press-in cylinder liner that requires lower insertion energy by reducing the distance over which the required insertion force must act. This object is achieved and disadvantages of prior art approaches are overcome, by providing a novel cylinder bore liner for internal combustion engines. In one particular aspect of the invention, a sheet of material in the shape of a non-rectangular parallelogram having oblique edges, is formed into a cylindrical liner by abutting the oblique edges such that the abutted edges are vertically offset, thereby forming a cylinder liner of smaller diameter than the diameter of the bore. The liner is then inserted into the bore with the trailing edge protruding from the top of the bore. A force generally parallel to the longitudinal axis of the cylinder bore is applied to the protruding edge of the liner. Because the abutting edges are oblique, a camming interface is formed, which, when the edges are forced to slide relative to each other, the diameter of the liner necessarily increases until a tight fit is achieved within the bore. In a preferred embodiment, the abutting edges of the sheet are formed into an interlocking pattern, preferably a male and female "v" pattern so as to be self aligning, thus preventing any buckling or deformation upon insertion due to misalignment. Additionally the liner can be made to be self-locking, in that the liner will retain its cylindrical expanded state. For example, the abutting edges of the sheet can be formed to be self-locking on insertion by either adding ratchets, tabs and indentations or by causing the cylinder head to overlap the top edge of the liner so as prevent reverse motion along the camming interface.

An advantage of the present invention is that a wide range of liner materials and thicknesses may be used thus allowing a wide selection of bore liner properties.

Another advantage of the present invention is that a lower cost of assembly may be provided by elimination of cylinder block heating and cooling, and reduction in energy costs required to force an interference fit.

Another advantage of the present invention is that an easy to manufacture bore liner may be produced.

Another advantage of the present invention is that the liner may be easy to repair or replace.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
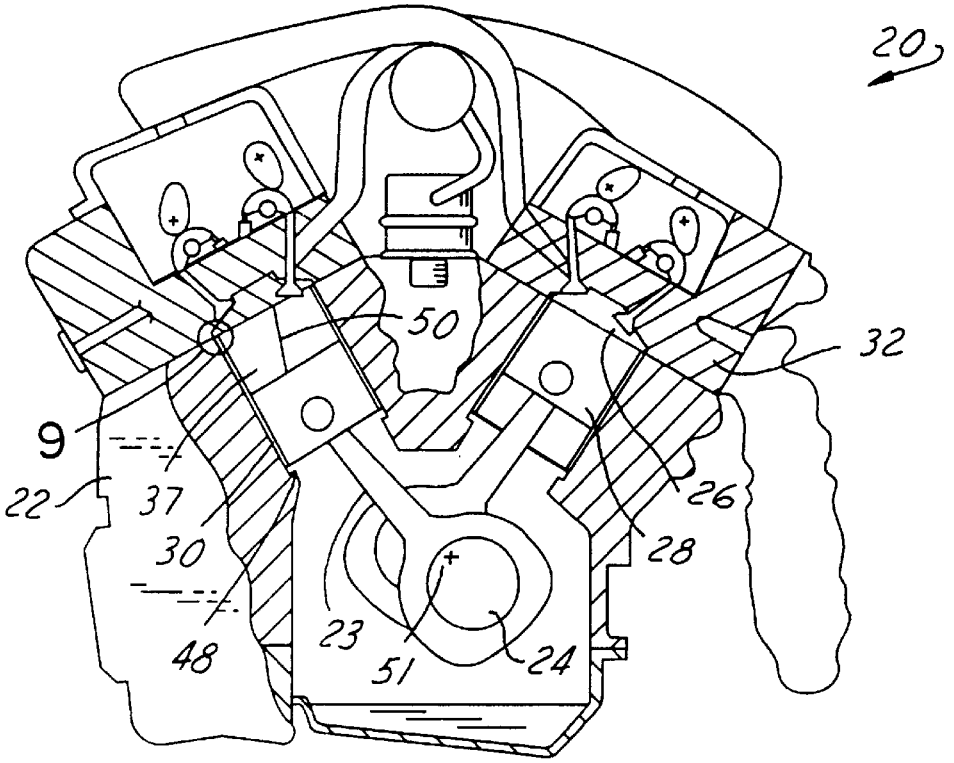
FIG. 1 is a cross sectional diagrammatic view of an internal combustion engine according to the present invention.

Internal combustion engine 20, shown in FIG. 1 in a typical V configuration, includes cylinder block 22, typically made of aluminum, having a plurality of cylinder bores 30 formed therein, which according to the present invention are lined as will be described hereinafter. Cylinder bores 30 house pistons 28 which connect rotatively to crankshaft 24 by connecting rods 23. Cylinder bore 30 extends between cylinder head 32 and shelf 48. Pistons 28 move within cylinder bores 30 compressing air and fuel causing combustion in combustion chamber 26, defined by cylinder head 32 and piston 28, as is well know to those skilled in the art.

Figure 2:
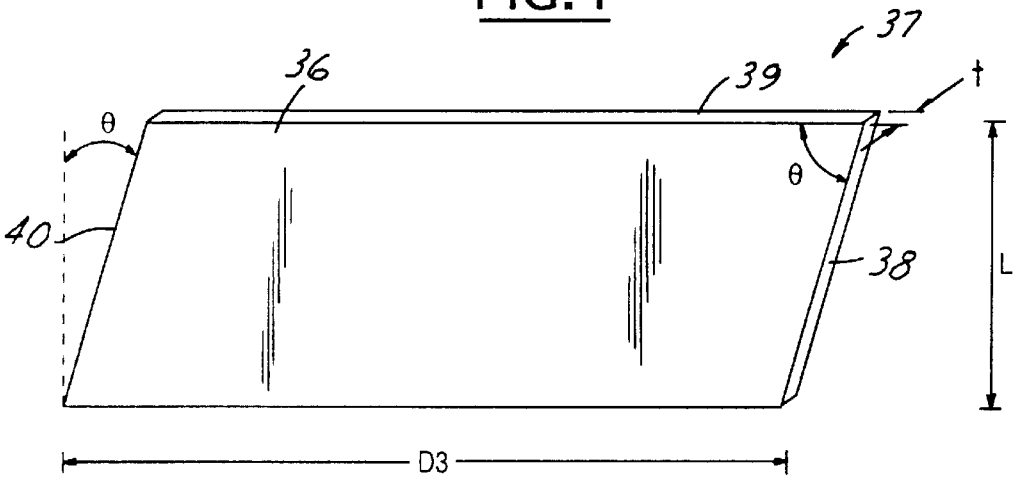
FIG. 2 shows a flat, oblique sheet of material used to form a cylinder bore liner for the engine according to the present invention.

According to the present invention, as best described with reference to FIGS. 2–5, bore 30 is provided with liner 37, which is formed from sheet material 36 shown in FIG. 2, shaped as a non-rectangular parallelogram with dimensions D3 determined by D1 of bore 30 (see FIG. 3), L determined by the depth L' of bore 30 (see FIG. 3), t, which is a function of the propensity to buckle, material properties, engine operating conditions, among other factors, and θ, which is a function of the desired press fit. In this example, θ is between 1° and 10° and preferably 7°.

Liner 37 comprises two states, an insertion state and an expansion state. In the insertion state, sheet 36, is rolled into cylindrical liner 37 in FIG. 3, of diameter D2, less than diameter D1 of bore 30, by abutting edges 38 and 40 in a vertically offset manner such that they create leading protruding edge 42 and trailing protruding edge 44. Abutting edges 38 and 40 create camming interface 50. Cylinder liner 37 is then inserted, leading protruding edge 42 first, into cylinder bore 30 of cylinder block 22 until leading protruding edge 42, reaches, for example, shelf 48 (see FIG. 4).

Figure 5:
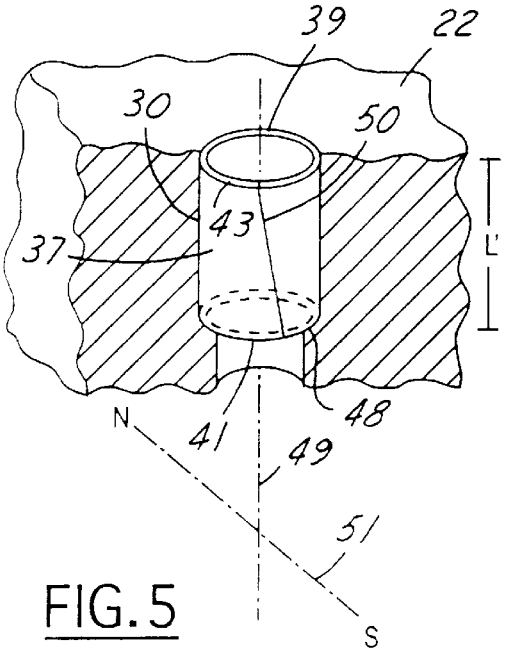

In the expansion state, a force generally parallel to longitudinal axis 49 of cylinder bore 30 is then applied to trailing protruding edge 44 to create a sliding motion along camming interface 50 of abutting edges 38 and 40. This forces an expansion of diameter D2 of liner 37 until D2 substantially equals diameter D1 of bore 30 and a desired press fit load is on liner 37 (see FIG. 5). Edge 41 is then flush with shelf 48 and edge 39 is flush with top of cylinder edge 43, completing the press fit as shown in FIG. 5. In a preferred embodiment liner 37 is positioned such that camming interface 50 is located on either the north or south side wall of the cylinder bore 30, with north and south lying along longitudinal axis 51 of crankshaft 24, as shown.

Figure 6A:
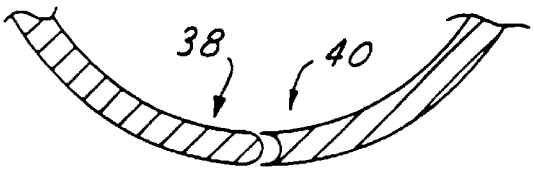
Figure 6B:
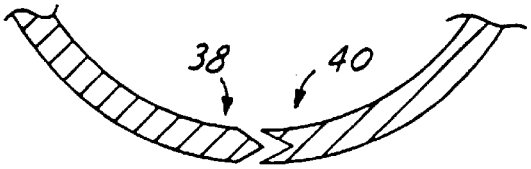

In an alternative embodiment, abutting edges 38 and 40 are configured into an interlocking pattern such that one edge has a generally concave shape while the mating edge has a generally convex shape, as shown in FIG. 6A, or a male and female "v" pattern, as shown in FIG. 6B. This causes edges 38 and 40 to be self aligning relative to each other, thus preventing any buckling or deformation upon insertion due to any misalignment.

Figure 7A:
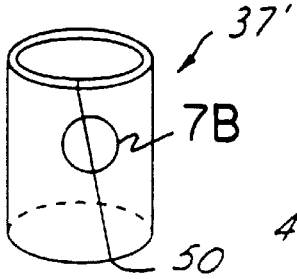
Figure 7B:
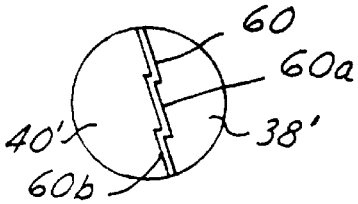

Liner 37 may be locked into bore 30 by any means known to those skilled in the art and suggested by the disclosure including welding, swaging, and bonding among other means. In particular, in a second alternative embodiment, as shown in FIGS. 7*a* and 7*b* , abutting edges 38' and 40' may be formed with ratchetting teeth 60 such that teeth 60*a* on abutting edge 38' lock with teeth 60*b* on abutting edge 40' when the press fit is complete, providing a locking mechanism for liner 37', thereby preventing reverse motion along the camming interface 50'.

Figure 8A:
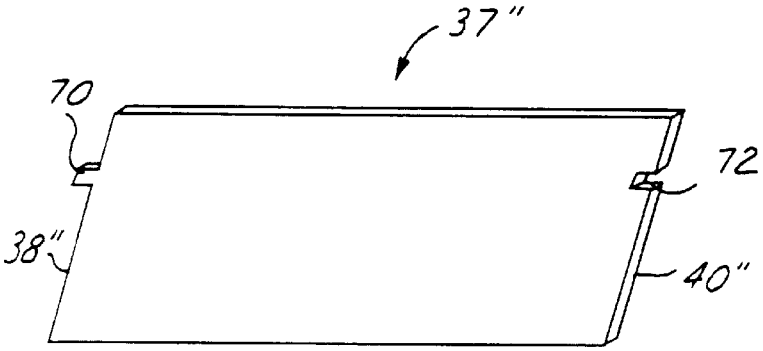
Figure 8B:
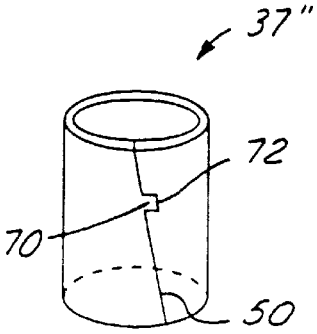

In a third alternative embodiment, as shown in FIGS. 8*a* and 8*b* , abutting edges 38" and 40" of liner 37" may be formed with tab 70 and indentation 72, respectively, such that when edges 38" and 40" are abutted in the fully expanded state, that is, when liner 37" is fitted within bore 30 according to the present invention, tab 70 inserts into indentation 72 providing a locking mechanism for liner 37" thereby preventing motion along the camming interface 50".

Figure 9:
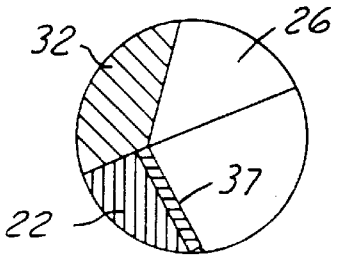
FIGS. 6–10 are alternative embodiments of the cylinder bore liner according to the present invention.
Figure 3:
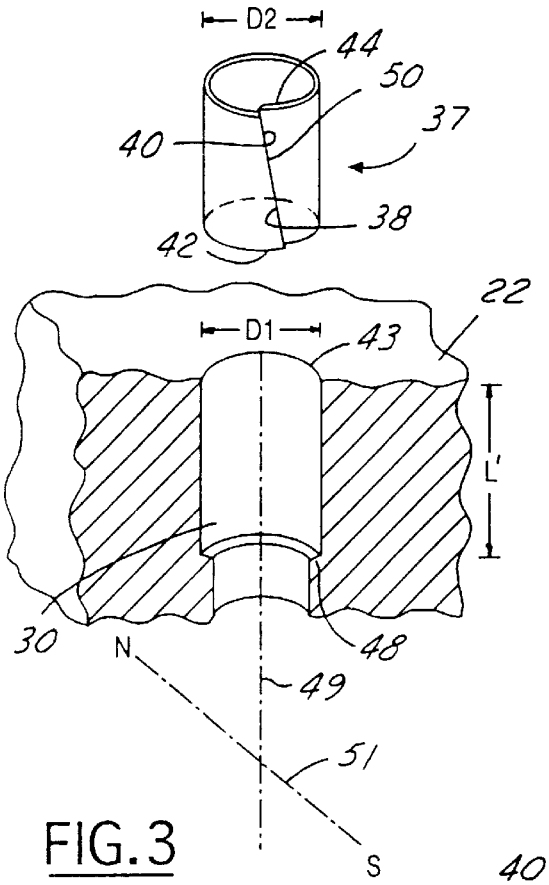
FIGS. 3–5 are diagrammatic representations of the insertion of the cylinder bore liner according to the present invention.
Figure 4:
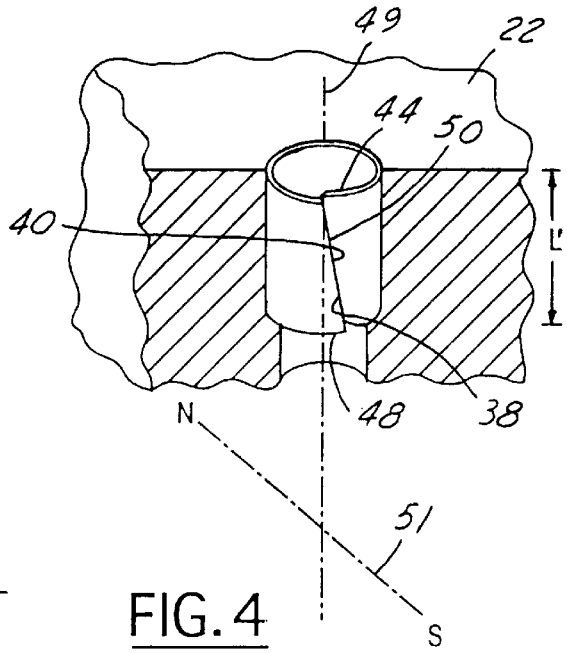

In a fourth alternative embodiment, cylinder head 32 overlaps cylinder liner 37, as shown in FIG. 9 to lock liner 37 in place between shelf 48 and cylinder head 32.

Figure 10:
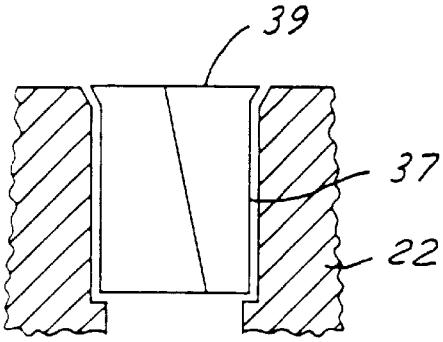

In a fifth alternative embodiment, edge 39 may be flanged, as shown in FIG. 10, in order to accommodate insertion of piston 28 with piston rings (not shown).

While the best mode in carrying out the invention has been described in detail, those having ordinary skill in the art in which this invention relates will recognize various alternative designs and embodiments, including those mentioned above, in practicing the invention that has been defined by the following claims.

I claim:

1. A cylinder bore liner for insertion into a cylinder bore of an internal combustion engine, the bore having a diameter and defining a longitudinal axis, the engine having a cylinder head, a piston reciprocally housed in the cylinder and a crankshaft rotatively connected to the piston, with said liner comprising:

an insertion state comprising:

a sheet of material shaped as a non-rectangular parallelogram, having a first and second oblique edge, with said sheet of material being formed into a cylindrical shape by abutting the oblique edges of said sheet, with said edges being initially vertically offset so as to form protruding leading and trailing edges and a first diameter of said cylindrical shape, with said first diameter being substantially less than the diameter of the bore so that said liner may be easily inserted into the bore; and, a camming interface formed by said abutment of said oblique edges; and, an expansion state comprising:

a cylindrical liner fitted within the bore, with said protruding edge being pushed in a direction generally parallel to the longitudinal axis of the cylinder bore, with said oblique abutting edges sliding relative to each other along said camming interface, such that said first diameter expands to substantially the diameter of the bore.

2. A cylinder bore liner as recited in claim 1, further comprising a means for locking said liner in the bore when in said expansion state.

3. A cylinder bore liner as recited in claim 2, wherein said abutting edges are formed with complementing ratchetting teeth, with said teeth locking said cylinder liner in said expansion state.

4. A cylinder bore liner as recited in claim 2, wherein said abutting edges are formed with an interlocking tab and corresponding indentation such that when said edges are abutted, said tab interlocks with said indentation, thereby locking said cylinder liner in said expansion state.

5. A cylinder bore liner as recited in claim 2, wherein said cylinder liner comprises a top edge when in said expansion state, with the cylinder head overlapping said top edge of said liner when said liner is positioned in said cylinder bore thereby locking said cylinder liner in said expansion state.

6. A cylinder bore liner as recited in claim 1, wherein the crankshaft of the engine defines a longitudinal axis having a north position at one end thereof and a south position at the other end thereof, with said liner being positioned in the bore such that said camming interface is located adjacent one of either a north and south side wall of the cylinder bore.

7. A cylinder bore liner as recited in claim 1, wherein said non-rectangular parallelogram shaped sheet has an internal acute angle between 1° and 10°.

8. A cylinder bore liner as recited in claim 1, wherein said cylinder liner comprises a top edge when in said expansion state, further comprising a radially outward flanged top edge.

9. A cylinder bore liner as recited in claim 1, wherein said abutting edges are formed with a means for interlocking said edges, with said interlocking edges thereby causing said liner to maintain a cylindrical shape upon insertion into the bore.

10. A cylinder bore liner as recited in claim 9, wherein said means for interlocking said edges comprises said first abutting edge having a generally concave shape and said second abutting edge having a generally convex shape.

11. A cylinder bore liner as recited in claim 8, wherein said means for interlocking said edges comprises said first abutting edge having a generally male "v" shape and said second abutting edge having a generally female "v" shape.

12. A cylinder bore liner for insertion into a cylinder bore of an internal combustion engine prepared by a method comprising the steps of:

forming a sheet of material into a non-rectangular parallelogram having oblique edges;

forming said sheet into a cylindrical liner;

vertically offsetting said edges such that said liner has a diameter smaller than the diameter of the bore, thereby defining a leading protruding edge and a trailing protruding edge;

inserting said cylindrical liner into the cylinder bore such that said trailing edge protrudes from the cylinder bore; and, applying a force to said protruding trailing edge, thereby causing said oblique edges to slide relative to each other and causing an expansion of said liner diameter until a desired press fit is obtained, thereby defining an expanded state.

13. A cylinder bore liner for insertion into a cylinder bore of an internal combustion engine prepared by a method, as recited in claim 12, further comprising the step of forming said abutting edges with a means for locking said liner in said expanded state.

14. A cylinder bore liner for insertion into a cylinder bore of an internal combustion engine prepared by a method, as recited in claim 12, wherein the crankshaft of the engine defines a longitudinal axis having a north position at one end thereof and a south position at the other end thereof, with said method further comprising the step of positioning said liner in the bore such that said abutting edges are located adjacent one of either a north and south side wall of said cylinder bore.

15. A cylinder bore liner for insertion into a cylinder bore of an internal combustion engine prepared by a method, as recited in claim 12, further comprising the step of locking one abutting edge relative to the other thereby causing said liner to maintain a cylindrical shape on insertion into the bore.

16. A method of lining a cylinder bore of an internal combustion engine, the bore having a diameter and defining a longitudinal axis, the engine having a cylinder head, a piston reciprocally housed in the cylinder and a crankshaft rotatively connected to the piston, comprising the steps of:

forming a sheet of material into a non-rectangular parallelogram having oblique edges;

forming said sheet into a cylindrical liner;

vertically offsetting said edges such that said liner has a diameter smaller than the diameter of the bore, thereby defining a leading protruding edge and a trailing protruding edge;

inserting said cylindrical liner into the cylinder bore such that said trailing edge protrudes from the cylinder bore; and, applying a force to said protruding trailing edge, thereby causing said oblique edges to slide relative to each other and causing an expansion of said liner diameter until said diameter substantially equals the diameter of the cylinder bore, thereby defining an expanded state.

17. A method of lining a cylinder bore as recited in claim 16, further comprising the step of forming said abutting edges with a means for locking said liner in said expanded state.

18. A method of lining a cylinder bore as recited in claim 16, wherein the crankshaft of the engine defines a longitudinal axis having a north position at one end thereof and a south position at the other end thereof, with said method further comprising the step of positioning said liner in the bore such that said abutting edges are located adjacent one of either a north and south side wall of said cylinder bore.

19. A method of lining a cylinder bore as recited in claim 16, further comprising the step of locking one abutting edge relative to the other thereby causing said liner to maintain a cylindrical shape on insertion into the bore.

20. A cylindrical bore liner formed in accordance with the method of claim 16.

* * * * *